United States Patent [19]

Whittington et al.

[11] Patent Number: 4,475,428

[45] Date of Patent: Oct. 9, 1984

[54] PEDAL CAPTURE KEYER SYSTEM

[75] Inventors: Billy J. Whittington, Jasper, Ind.; Joseph E. Macke, Glendale, Ariz.

[73] Assignee: Kimball International, Inc., Jasper, Ind.

[21] Appl. No.: 424,900

[22] Filed: Sep. 28, 1982

[51] Int. Cl.[3] ..... G10H 1/00

[52] U.S. Cl. ..... 84/1.01; 84/1.03; 84/DIG. 2

[58] Field of Search ..... 84/1.03, 1.17, 1.01, 84/1.24, DIG. 2

[56] References Cited

U.S. PATENT DOCUMENTS

| | | | |
|---|---|---|---|
| 3,610,799 | 10/1971 | Watson | 84/1.01 |
| 3,610,806 | 10/1971 | Deutsch | 84/1.26 |
| 3,981,217 | 9/1976 | Oya | 84/1.03 |
| 4,176,573 | 12/1979 | Deutsch | 84/1.01 |
| 4,186,637 | 2/1980 | Swain | 84/1.01 |
| 4,319,509 | 3/1983 | Starkey | 84/1.03 |
| 4,350,069 | 9/1982 | Howell | 84/1.03 |
| 4,375,176 | 3/1982 | Machanian | 84/1.03 |

*Primary Examiner*—Forester W. Isen

*Attorney, Agent, or Firm*—Jeffers, Irish & Hoffman

[57] ABSTRACT

The present invention relates to a keyer capture system for an electronic keyboard musical instrument, such as an electronic organ. The system is particularly adapted for the situation wherein a relatively low number of notes are required to be captured at one time, such as in the case of the pedals. The system is responsive to serial data for the pedals and the two keyers are captured on a priority basis with the master keyer given preference. If the note is already captured by the other keyer, then that note will not be captured by the keyer which is receiving the keydown pulse for that note, and a recirculating shift register for each keyer keeps track of which note that keyer has captured. The system is capable of being easily integrated into an electronic organ wherein the pedal data is in serial time division multiplexed format, and can be implemented as an accessory wherein it is desired to generate the pedal data from the lowest actuated key on one of the manuals.

19 Claims, 9 Drawing Figures

CAPTURE DETECT CIRCUIT 46

PEDAL CAPTURE KEYER SYSTEM

BACKGROUND OF THE INVENTION

The present invention relates to an electronic keyboard musical instrument, and in particular to a capture system for such an instrument wherein there are fewer tone generator-keyers than keys or pedals, and each keyer is capable of capturing the data of any of the keys or pedals and controlling a tone generator to produce a corresponding tone.

An important aspect of organs and other electronic musical instruments, other than very small instruments with a very limited pedalboard or no pedalboard at all, is the production of pedal tones. In many smaller prior art organs, the pedalboard is monophonic with a priority system between the switches operated by the pedals so that only one switch is enabled at any time and the keyer system is capable of producing only one tone at a time. Because of the type of music often played on organs of this type, a monophonic pedal system is usually quite adequate.

In larger organs, such as large theater organs and institutional organs of the type used in churches, the performers generally possess a higher degree of skill, and the music written for such organs is much more complex. In such music, it is often necessary to play more than one pedal at a time so that a monophonic pedal system is not at all satisfactory. In most organs of this size, the pedalboard comprises thirty-two pedals, and thirty-two keyer units are required, thereby increasing the cost of the instrument, and in some cases prohibiting the addition of other features because of cost limitations. Such a system is quite redundant, however, because normally no more than two pedals are played at any given time so that much of the keyer system is inactive.

For many years now, capture keyer-tone generator systems have been utilized wherein there are less keyer-tone generators than keys to be played, and each keyer-tone generator is capable of producing a tone selected by any one of the keys or pedals to which it is assigned. This permits polyphonic playing without the necessity for having large banks of keyers, but has the drawback that many systems were often complicated and required a substantial amount of logic or even a microprocessor to capture and release the keyers in the proper manner. In many cases, it was necessary to utilize sophisticated memory addressing logic to determine which note a tone generator had captured and which tone generators were available for further assignment. Furthermore, due to the differences of processing the keyboard data in a capture keyer system as opposed to a more conventional keyer bank system, it was difficult to implement capture layer technology into existing organs without substantial modification.

SUMMARY OF THE INVENTION

The present invention concerns a capture keyer system that is particularly well adapted to be used for producing polyphonic pedal tones wherein as few as two tone generators are necessary to accommodate most music which is played. Because there are only two tone generators, it is not necessary to resort to sophisticated memory addressing circuitry or the use of a microprocessor to monitor which notes the keyers have captured and make decisions as to the assignment of new notes to uncaptured keyers. Each capture keyer of the present invention is responsive to a time division multiplexed serial data stream for the pedalboard, which data stream is already being produced in most organs on the market today, by capturing one of the cyclically recurring keydown pulses in the data stream for assignment of the tone generator.

The system utilizes a recirculating serial memory, such as a shift register, which recirculates the captured keydown pulse and continuously compares this with the incoming keydown pulses through a gating circuit to determine whether the captured key has been released. As long as the recirculated keydown pulse is time coincident with an incoming pulse for each scan of the pedalboard, then the keyer remains captured and is unavailable for the capturing of any new notes.

In the preferred embodiment, a master keyer and a slave keyer are provided wherein the master keyer takes priority over assignments if both keyers are currently unassigned. Once the master keyer has been assigned by capturing a keydown pulse in the data stream, then the slave keyer is available for capturing another keydown pulse so that the tone generating circuitry can produce simultaneously two tones corresponding to two depressed pedals. If a keydown pulse has already been captured by one of the keyers, then the other keyer is locked out from capturing this same pulse. All this is accomplished in serial data format and in synchronism with the multiplexing of the pedalboard thereby substantially reducing the amount of logic necessary to monitor and update the keyers as new pedals are depressed.

The system also includes a provision for generating a bass tone corresponding to the lowest depressed key in the lower octaves of one of the keyboards. Selection circuitry selects either the serial data stream from the pedalboard or the single keydown pulse from the automatic bass circuitry for capturing of one or more keyers in the case of regular pedal data, and only one keyer in the case of automatic bass data. Since the pedalboard and keyboard are scanned simultaneously, the same capture circuitry and tone generation circuitry can be utilized for both. Although a distinction has been made between pedals and keys, the term "keyboard" is intended to cover any keyboard or pedalboard which is actuated by the hands or feet of the performer for the purpose of causing the organ to produce a tone. Some of the claims are generic both to keyboards played by the hands and the pedal keyboard, or pedalboard, played by the feet, whereas other claims make a distinction between these two.

The present invention contemplates an electronic keyboard musical instrument, such as an electronic organ, which comprises a keyboard having a plurality of playing keys, played either by the hands or the feet, multiplexer means for scanning the keyboard and producing a time division multiplexed serial data stream comprising a plurality of time slots corresponding to respective keys of the keyboard and keydown pulses in time slots corresponding to actuated ones of the keys of the keyboard. The keyer circuit of the present invention comprises a capture circuit having an input to which the serial data stream is connected for capturing any uncaptured one keydown pulse that may be present in the serial data stream if the capture circuit is in the available mode, and means responsive to the capturing of the keydown pulse for placing the circuit in the unavailable mode as long as the keydown pulse is captured thereby.

The captured circuit is disabled from capturing a further keydown pulse when in the unavailable mode. A recirculating memory synchronized with the data stream recirculates the captured keydown pulse, and the capture circuit includes a gating circuit having an input connected to the serial data stream and an input to which the recirculated keydown pulse is connected for rejecting all keydown pulses in the data stream except those that are time coincident with the recirculated keydown pulse. Tone code producing means having an input to which the captured keydown pulses are connected, produces a coded signal responsive to the time position of the captured keydown pulse wherein the coded signal pertains to the tone corresponding to the time position of the captured keydown pulse.

A plurality of such keyers are provided according to the preferred embodiment of the invention and a priority selection circuit connected with all the keyer circuits causes those keyer circuits which are in the available mode to capture keydown pulses in the serial data stream in a predetermined order. A lockout circuit connected to each of the keyers prevents the respective keyer circuit from capturing a keydown pulse already captured by another keyer circuit.

According to yet another aspect of the invention, the organ has a pedalboard with a plurality of pedals normally played by the feet of the performer, a keyboard with a plurality of playing keys normally played by the hands of the performer, a pedal multiplexer for scanning the pedalboard and producing a time division multiplexed serial data stream comprising a plurality of time slots corresponding to the pedals of the pedalboard with keydown pulses in time slots pertaining to the actuated pedals, and a keyboard multiplexer for scanning the keyboard and producing a keyboard time division multiplexed serial data stream comprising a plurality of time slots corresponding to the keys of the keyboard with keydown pulses in time slots pertaining to the actuated keys. The time slots corresponding to keys and pedals having like pitch and octave positions occur simultaneously so that the data streams are synchronized with each other. The invention is a system for producing tones comprising a selectively actuatable automatic bass generator having an input to which the keyboard data stream is connected and means for selecting only a single cyclically recurring keydown pulse in the keyboard data stream pertaining to the lowest key of the keyboard within a selected group of keys. A selector connects either the pedal serial data stream or the selected cyclically recurring pulse in the keyboard data stream to the capture circuit input, and the capture circuit includes means for capturing either the selected keydown pulse or for any uncaptured one keydown pulse that may be present in the pedal data stream. The capture circuit is placed in an unavailable mode as long as a keydown pulse is captured thereby so as to disable it from capturing any further pulse, and a recirculating memory recirculates the captured keydown pulse in synchronism with the data stream and prevents the capturing of a further keydown pulse in a time slot other than a time slot of the recirculating keydown pulse.

It is an object of the present invention to provide a capture keyer system for an electronic musical instrument which is responsive to serial keyboard data from a multiplexed keyboard, and which can be easily integrated into existing multiplexed organ technology.

DETAILED DESCRIPTION OF A PREFERRED EMBODIMENT

Figure 1:
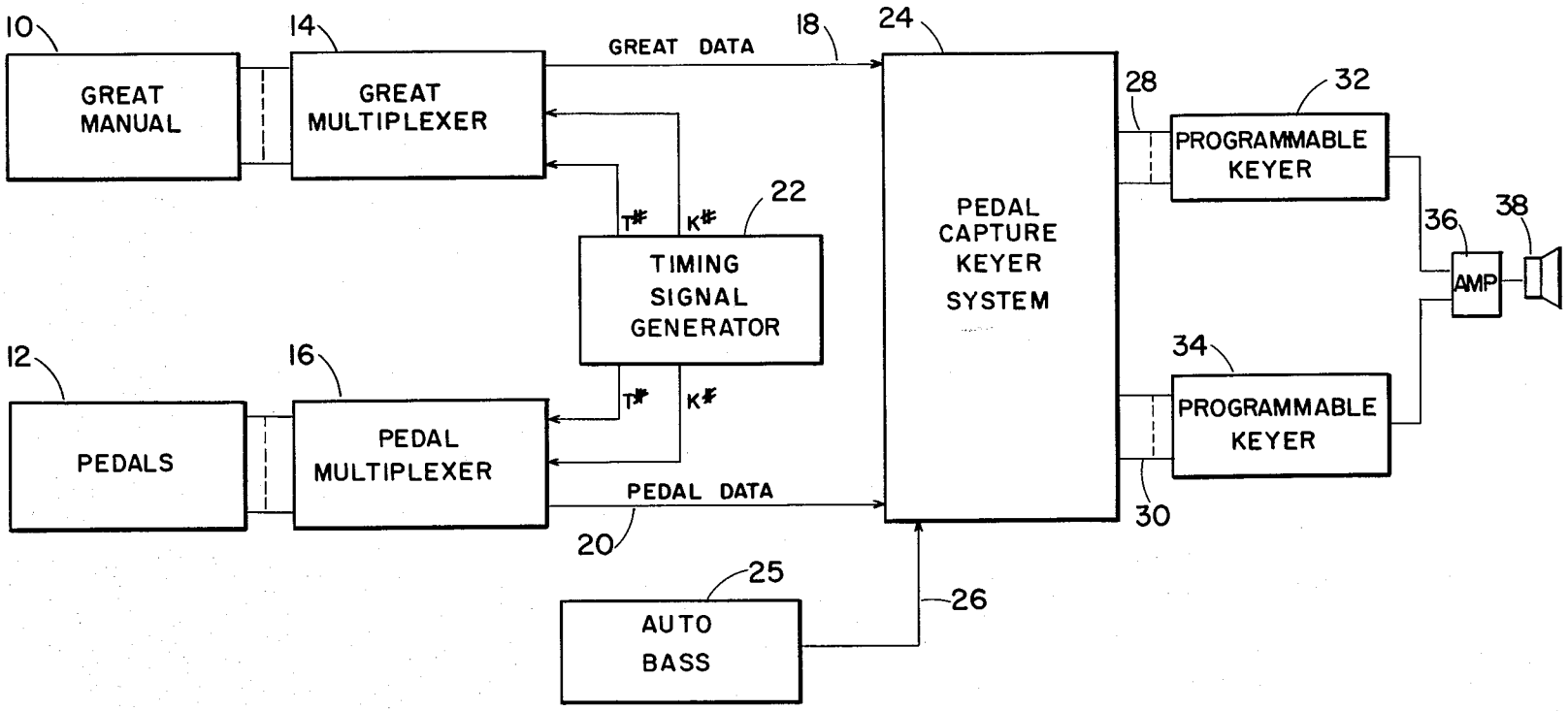
FIG. 1 is a block diagram of an electronic organ including the pedal capture keyer system of the present invention.

Referring now in detail to the drawings, and in particular to FIG. 1, Great manual 10 and pedalboard 12 are multiplexed by multiplexers 14 and 16, respectively, thereby generating on lines 18 and 20 serial data which is in a time division multiplexed format. Specifically, the serial data on line 18 comprises a plurality of time slots corresponding on a one-to-one basis to the keys of Great manual 10 wherein negative-going pulses appear in those time slots corresponding to depressed keys of the manual 10. In a like fashion, the time slots of the serial data on line 20 correspond on a one-to-one basis to the pedals 12 wherein negative-going pulses appear in time slots for depressed ones of the pedals. The timing for the multiplexing is accomplished by a series of T numbers and K numbers produced by timing signal generator 22 and controlling the signals on the drivers and receivers for multiplexers 14 and 16. The various combinations of the T and K numbers produce a plurality of separate states corresponding to the time slots of the Great manual 10 and pedalboard 12. The technique for generating these numbers and their relationship to the manuals 10 and 12 is described in detail in allowed patent application Ser. No. 220,309 filed Dec. 29, 1980, now U.S. Pat. No. 4,350,069, which application is specifically incorporated herein by reference. Although the positions of the K and T numbers relative to the time slots of the Great manual 10 and pedalboard 12 are not identical to those set forth in said application, the technique for generating these numbers from the multiplexer drivers and receivers is very similar.

In the present application, the K numbers change slowly from K0 to K7, and the T numbers change through the sequence of T0 to T7 for each state of the K numbers. For the pedals 12, the sweep is begun on K3T7 and ends on K7T7, which is the end of scan time frame. Like the system described in the aforesaid U.S. Pat. No. 4,350,069, the present system includes an automatic bass feature whereby the lowest depressed key on the Great manual produces a corresponding tone in the frequency range of the pedals. This enables the performer to play pedal tones without actually depressing the pedals, and the effect has been found to be quite acceptable from a musical standpoint. In the automatic bass mode, only the two lowest octaves of keys on the Great manual are monitored, and the sweep of these keys is begun on K4T7 and, like the pedalboard, ends on K7T7. The pedalboard 12, since it includes 32 pedals, has a larger window than does the automatic bass mode.

The serial data streams on lines 18 and 20 are connected to pedal capture keyer system 24, and the control 25 for the automatic bass system is connected to pedal capture keyer system 24 by output 26. The outputs 28 and 30 of capture keyer system 24 each carries a multiple bit word in pitch and octave format relating to the tone to be produced, and control their respective programmable keyers 32 and 34, the outputs of which are connected through amplifier 36 to speaker system 38. Keyers 32 and 34 can be one of a wide variety of keyer types, such as programmable dividers, tone selectors and the like.

Figure 2:
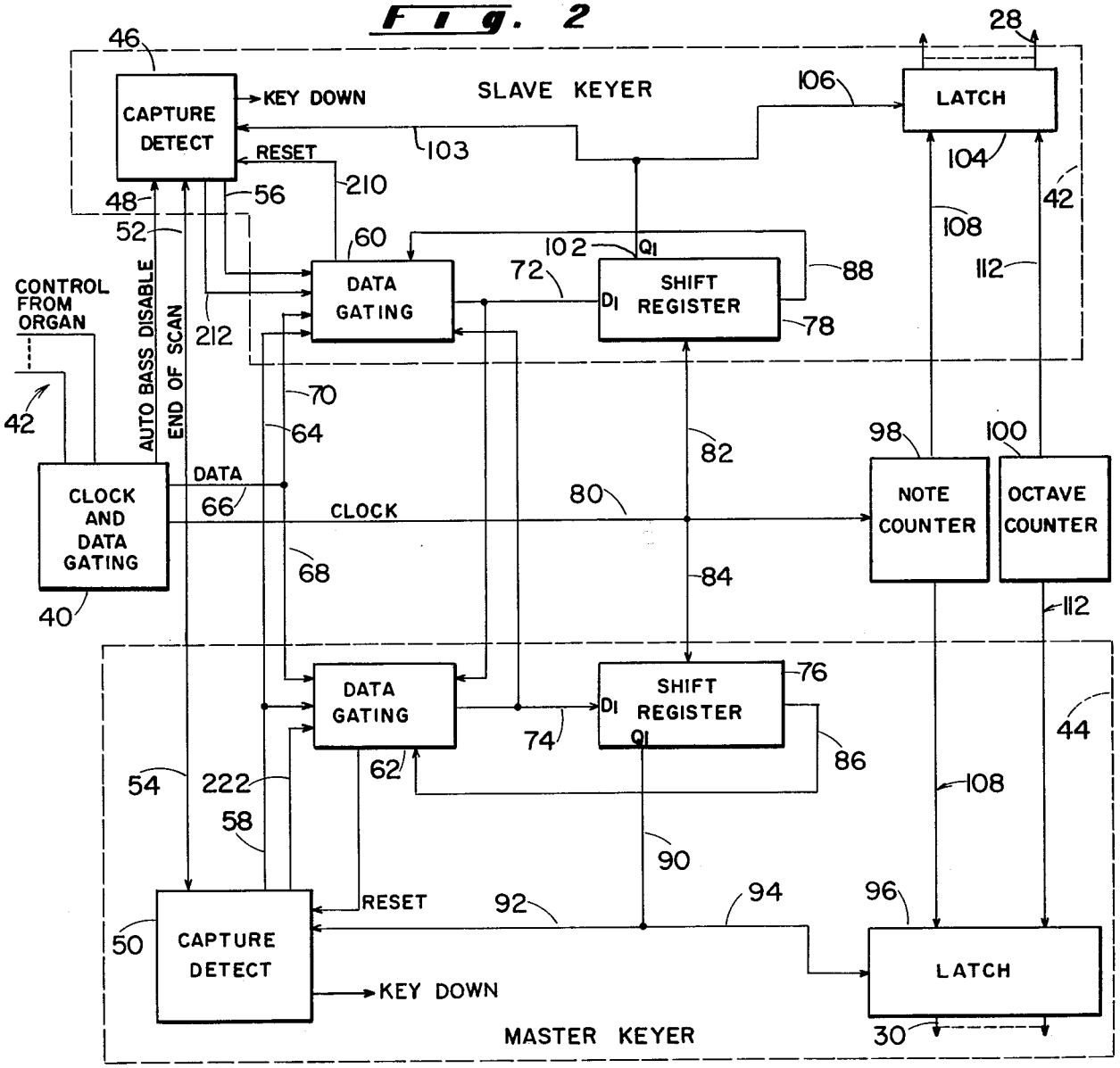
FIG. 2 is a block diagram of the pedal capture keyer system.

Referring now to FIG. 2, the various control signals of the organ, such as the serial data on lines 18 and 20, the automatic bass signal on line 26, and the K and T timing signals are connected to clock and data gating block 40 over lines indicated generally as 42. The pedal capture keyer system 24 comprises a master keyer 44 and a slave keyer 42 thereby enabling two pedal tones to be captured at one time in the pedal mode, whereas in the automatic bass mode, only the master keyer 44 is capable of being captured. The capture detect block 46 of slave keyer 42 is disabled by a signal on line 48 from clock and data gating block 40 in the automatic bass mode. The end of scan signals are connected to capture detect 46 and capture detect 50 for the slave and master keyers, respectively, by respective lines 52 and 54. Capture detect circuits 46 and 50 provide signals on their respective outputs 56, 212 and 58, 222 connected to the data gating blocks 60 and 62 for the slave and master keyers 42 and 44 indicating whether that particular keyer has been captured. The output 58 of capture detect circuit 50 is also connected to the data gating block 60 for slave keyer 42 by line 64, which enables slave keyer 42 to be captured in the event that master keyer 44 is not available. The capture system is a priority-type system, however, in that master keyer 44 will always capture the note if it is available and if that same note is not already captured by slave keyer 42.

The serial data for the Great and Pedal manuals 10 and 12 on lines 18 and 20 is selected by clock and data gating circuit 40 to produce a single data stream on output 66, which is connected by lines 68 and 70 to data gating circuits 62 and 60, respectively, for the master and slave keyers 44 and 42. Depending on the state of automatic bass control 25 (FIG. 1) either the pedal serial data or the automatic bass data generated by the lower two octaves of the Great manual 10 will be selected. Clock and data gating circuit 40, in addition to selecting either the pedal or automatic bass data, opens a window for the sweep of the pedals or automatic bass portion of the Great manual 10.

Data gating circuits 60 and 62 determine whether a bit of serial data will be accepted and captured by either of master keyer 44 or slave keyer 42 as will be described in detail hereinafter. The data pulses selected by gating circuits 60 and 62 are connected by lines 72 and 74 to the data inputs of thirty-three bit shift registers 76 and 78, which are clocked by the multiplex clock train on lines 80, 82 and 84. The outputs 86 and 88 of shift registers 76 and 78 are connected to data gating circuits 62 and 60, respectively, thereby recirculating the data pulse loaded therein until the corresponding key is released. Although the scan of the pedalboard is only thirty-two bits long, an extra stage of shift register is necessary to accommodate for the time between scans. The output 90 of this first stage of shift register for master keyer 44 is connected to capture detect block 50 by line 92 thereby placing it in an unavailable state, and is also connected by line 94 to the clocking input of latch 96. Note counter 98 and octave counter 100 which are modulo 12 and modulo 3 counters, respectively, count through the various pitch and octave states thereby loading their counts into latch 96, and the states are latched therein by the pulse on 94 in the time frame corresponding to the particular note played. In like manner, the output 102 of the first stage of shift register 78 is connected to capture detect circuit 46 by line 103, and is connected to the latch 104 for slave keyer 42 by line 106. Note counter 98 is connected to latches 96 and 104 by lines 108 and octave counter 100 is connected to latches 96 and 104 by lines 112.

Figure 3:
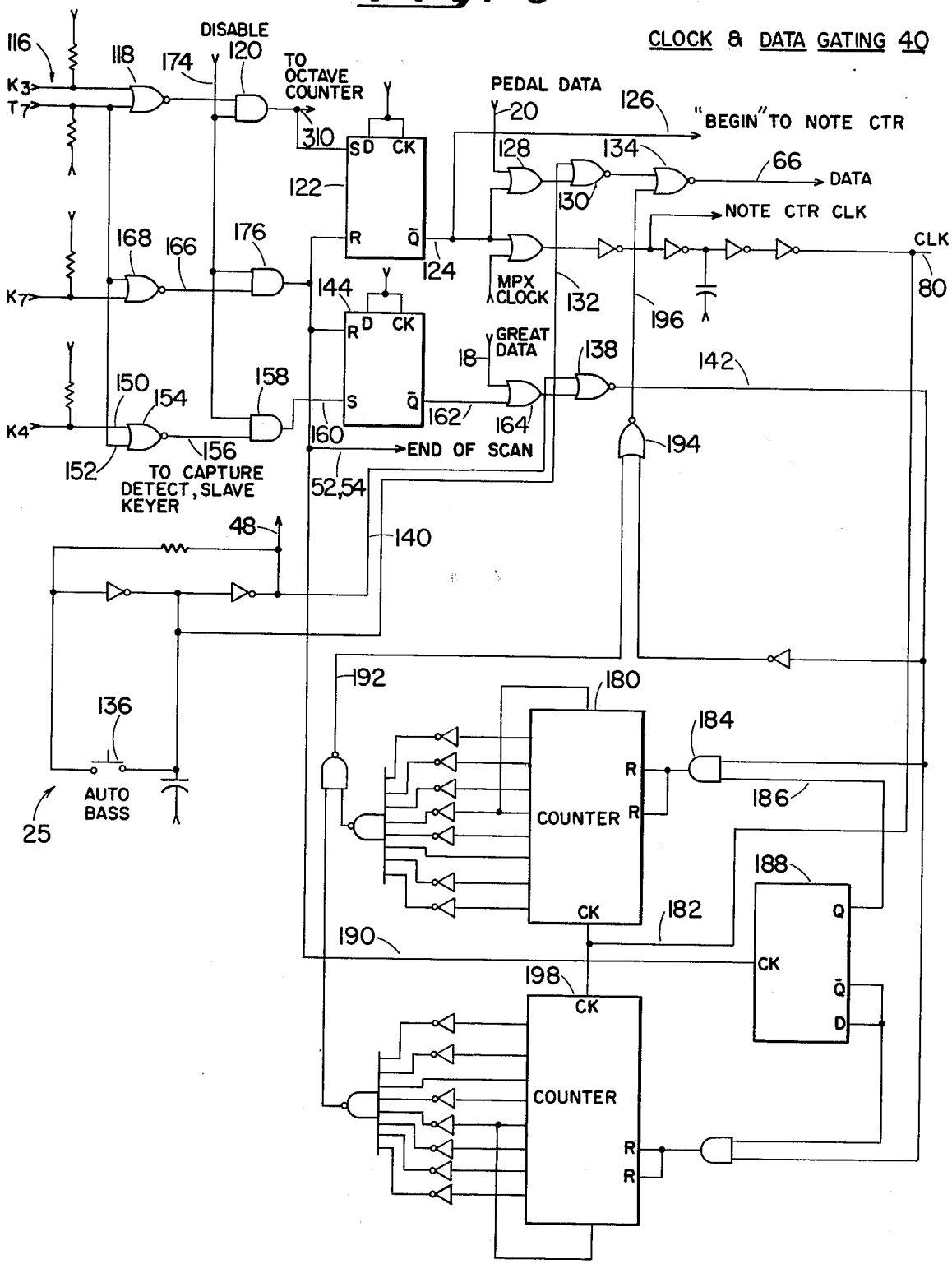
FIG. 3 is a circuit schematic of the clock and data gating.

FIG. 3 shows the clock and data gating circuit 40 wherein the K3T7 signal on lines 116 is connected through NOR gate 118 to one of the inputs of AND gate 120 and from there to the Set input of D-type flip-flop 122. On the occurrence of the K3T7 signal, flip-flop 122 is set thereby causing the $\overline{Q}$ output 124 to go low and produce a logic 0 on line 126, which starts note counter 98. This also enables OR gate 128 to pass the pedal data on line 20 if the system is not in an automatic bass mode. If the system is in the pedal mode, NOR gate 130 will be enabled by the signal on line 132 from automatic bass circuit 25 and will pass through NOR gate 134 to data output line 66. If the system is in the automatic bass mode, however, by the closing of switch 136, then NOR gate 130 will be disabled and NOR gate 138 enabled by the signal on line 140 so that great data on line 18 can pass to output 142 if flip-flop 144 is set. Flip-flop 144 will be set at time K4T7 by the signals on lines 150 and 152 through NOR gate 154, line 156 and AND gate 158 to the set input 160 of flip-flop 144. This will cause the $\overline{Q}$ output 162 to go low thereby enabling OR gat 164 to pass great data on line 18 beginning with the scan of the top note in the lowest two octaves of great manual 10. At time K7T7, which is the end of the scan of the Great manual 10 and pedalboard 12, the output 166 of NOR gate 168 will reset flip-flops 122 and 144 thereby closing the "window" for the scan of Great manual 10 and pedalboard 12. If the keyer system of the present invention is utilized in the type of system disclosed in the aforementioned patent application Ser. No. 220,309, it will be necessary to disable the keyers from capturing data on alternate scans of the manuals, and to accomplish this, a disable signal is produced by the control circuitry of the organ on line 174 thereby disabling AND gates 120, 176 and 158 so that the system is disabled from capturing data.

In the automatic bass mode, data from pedals 10 is blocked and the data from the lowest two octaves of Great manual 10 is utilized to capture data for a single tone. Since this tone corresponds to the lowest depressed key in the lowest two octaves of the Great manual 10, regardless of how many keys are depressed, it is necessary to detect which key is the lowest. This is accomplished by using a thirty-two bit counter 180 that is clocked by the multiplex clock train on line 182 and reset by the output of AND gate 184, one input of AND gate 184 being connected to the great data stream on line 142 and the other input 186 connected to the Q output of flip-flop 188. Flip-flop 188 is clocked by the end of scan signal on line 190 generated at the time K7T7 thereby causing its Q output 186 to go high after the end of scan so that AND gate 184 will pass each data pulse from the scan of the lowest two octaves of Great manual 10 thereby resetting counter 180 each time this occurs. Counter 180 will produce a pulse on output 192 thirty-two counts after it is reset by the last pulse appearing in the great data stream on line 142. Since the available window is only thirty-two bits wide, pulses prior to the last keydown pulse will cause counter 180 to be reset before it is able to produce its output pulse on line 192. Since the scan of pedalboard 12 is exactly thirty-two bits wide, this pulse will appear in the next scan in the same time slot so that the data will pertain to exactly the same key as is depressed. This data pulse is passed by NOR gate 194 to line 196 and from there through NOR gate 134 to the data output line 66.

If the system is used in the alternating scan mode described earlier, wherein data from the manuals and pedalboard is ignored on alternate scans, it is necessary to use a second counter 198 which is substantially identical to counter 180. Counters 180 and 198 are alternately enabled by flip-flop 188 so that each counter is allowed to complete its count of thirty-two after the last note without being reset by data from the next scan.

When the system is in the pedal mode, the circuit of FIG. 3 operates to produce a series of keydown pulses on line 66 corresponding to the depressed pedals of the pedalboard, and two of these pulses can be captured by the master and slave keyers 44 and 42. In the automatic bass mode, only the master keyer 44 is enabled to capture a single pulse on line 66, which is generated by the counter circuitry for the automatic bass system.

Figure 4:
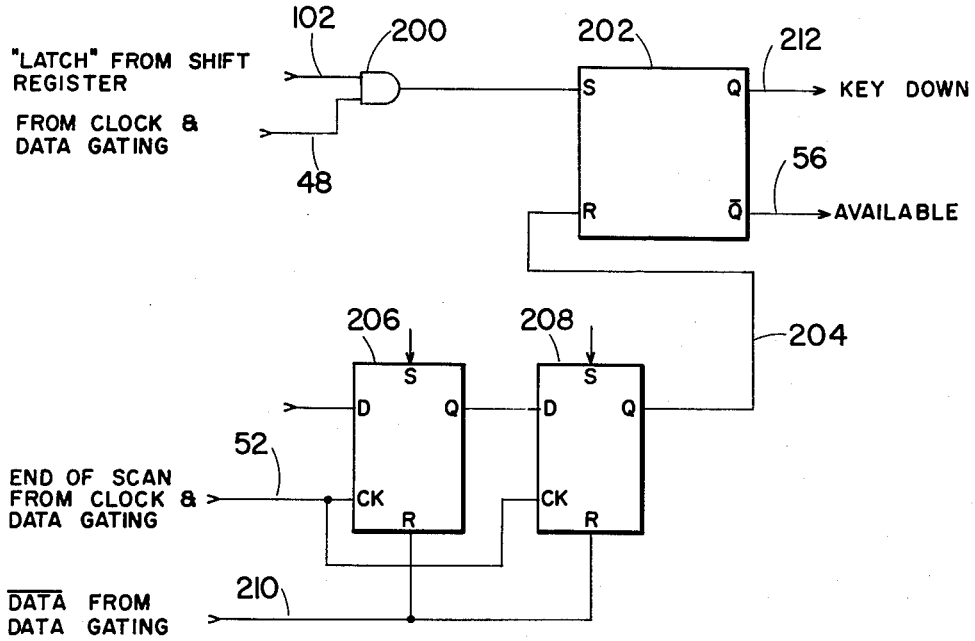
FIG. 4 is a circuit schematic of the capture detect circuit.

FIG. 4 shows the capture detect circuit 46 for slave keyer, which monitors whether the keyer 42 has been captured. The capture detect circuit 50 for master keyer 44 differs only in that AND gate 200 and the disable input 48 from the automatic bass circuit 50 is not present. Flip-flop 202 is set by the data output 102 of the first stage of shift register 78 (FIG. 2), and is reset by the pulse on line 204, which occurs after two consecutive end of scan signals on line 52. Flip-flops 206 and 208 function as a two scan delay for the end of scan signal on 52 and will reset flip-flop 202 unless they are reset by a $\overline{\text{data}}$ signal on line 210 from data gating circuit 60. If no pulse appears on line 210 for two consecutive scans, then the system recognizes the key as having been released and will reset flip-flop 202 thereby indicating that slave keyer 42 is now available to capture a note. When flip-flop 202 is set thereby indicating an unavailable state, the Q output 212 will be high and the $\overline{Q}$ output 56 will be low. Conversely, when flip-flop 202 is reset, the keydown output 212 will be low and the available output 56 will be high. Flip-flop 202 is prevented from being set by the automatic bass disable signal on line 48, which disables AND gate 200 when the system is in the automatic bass mode.

Figure 5:
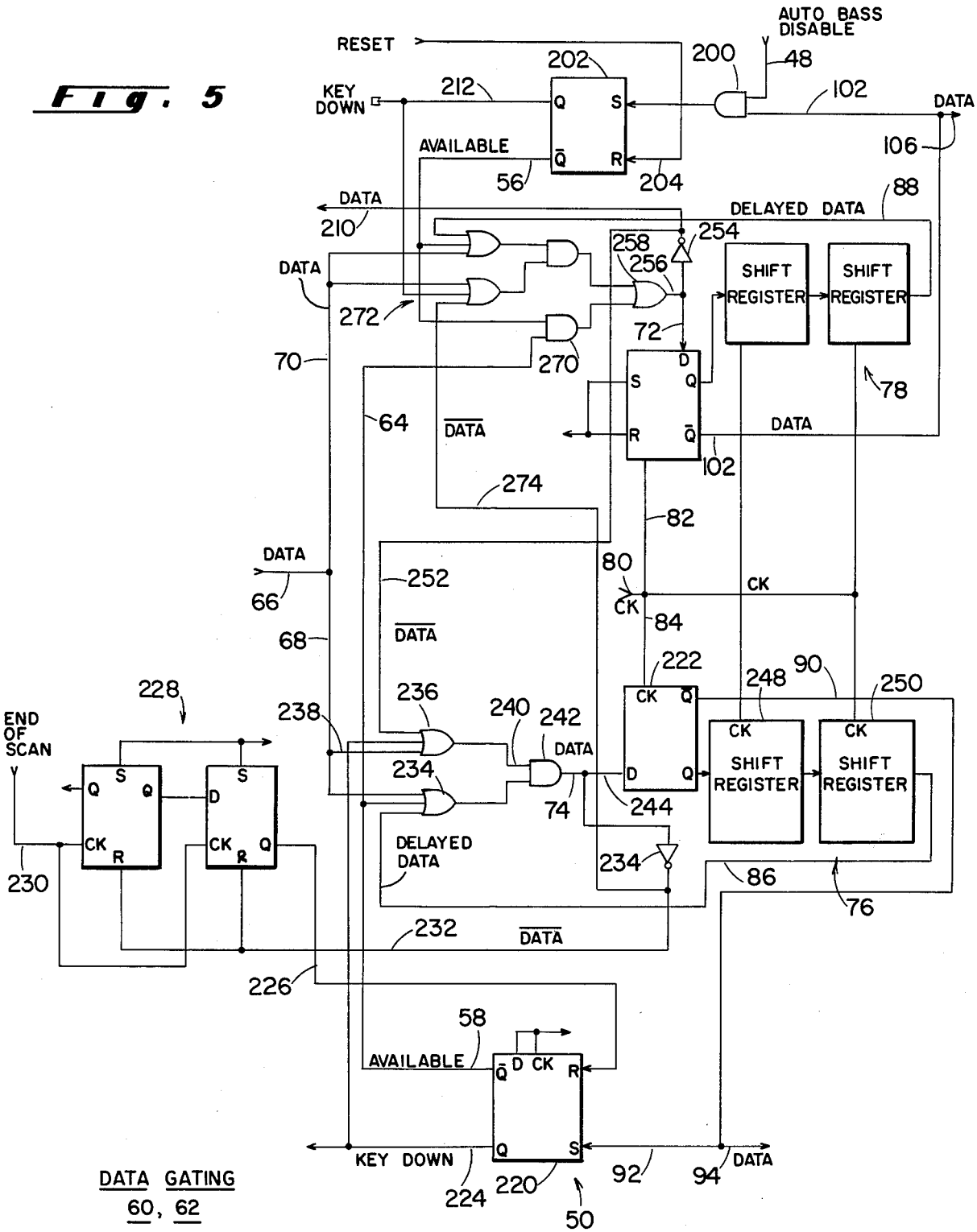
FIG. 5 is a circuit schematic of another portion of the data gating.

FIG. 5 illustrates the manner in which the flip-flop 202 of capture detect circuit 46 (FIG. 4) is connected to the data gating circuit 60, and further illustrates the details of capture detect circuit 50 for master keyer 44. Flip-flop 220 is set by the data pulse on line 92 connected to the first stage of shift register 76, which is flip-flop 222, thereby causing its Q output 224 to go high and its $\overline{Q}$ output 58 to go low. Flip-flop 220 is reset by a pulse on line 226, which is produced by shift register 228 after two consecutive end of scan signals on line 230 unless it is reset by a $\overline{\text{data}}$ pulse on line 232 from the output of inverter 234 connected to line 74.

Figure 6:
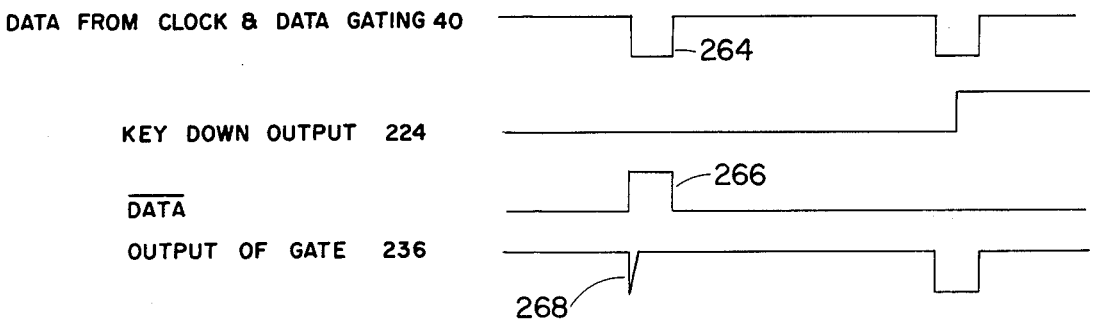
FIG. 6 is a timing diagram for the data gating.

Describing first the data gating circuit 62 for master keyer 44, with no data present on line 66 and with flip-flop 220 in the reset mode, keyer 44 is in the available mode and the available output 58 will be high with the keydown output 224 low. This clamps the output of OR gate 234 high but permits OR gate 236 to pass the first negative going data pulse on line 238 to the input 240 of AND gate 242. AND gate 242, which was previously high due to the absence of a data pulse on the inputs of OR gates 234 and 236, will now go low thereby loading the data pulse into shift register 222 through its D input 244. At the same time, inverter 234 will invert this pulse to reset flip-flops 228 thereby preventing the end of scan signal on line 230 from passing through and resetting flip-flop 220. On the next multiplex clock pulse on line 84, flip-flop 222 is clocked and the data pulse is subsequently shifted through shift registers 248 and 250. Simultaneously, the $\overline{Q}$ output will go high so as to set flip-flop 220 causing it to change to the unavailable or captured state thereby producing a low on output 58 and a high on output 224. This clamps the output of OR gate 236 high and permits OR gate 234 to pass a negativegoing recirculated data pulse on line 86. Whether the note is captured is determined by the $\overline{\text{data}}$ input 252 from the output of inverter 254 connected to the output 256 of OR gate 258 in slave keyer 42. If the data pulse on the input 238 of OR gate 236, which is the data pulse that master keyer 44 is attempting to capture, is coincident with a data pulse which has already been captured by slave keyer 42 by virtue of the presence of this pulse on the output 256 of OR gate 258, then the inversion of this pulse coincident with the pulse on 238 will prevent the pulse from passing through OR gate 236 and master keyer 44 will not capture the note. This prevents the two keyers 42 and 44 from attempting to capture the same note. The timing arrangement for this is illustrated in FIG. 6 wherein the pulse 264 is the data pulse which keyer 44 is attempting to capture and pulse 266 is the pulse for the note that slave keyer 42 has already captured. As will be seen, these two pulses 264 and 266 are coincident in time and will cancel each other out. The timing spike 268 is not significant because the data is not latched until the following positive going edge of the clock.

Assuming that slave keyer 42 is not yet captured the note, when the pulse reaches the output of AND gate 242, the following positive clock edge clocks it into shift register 76 and sets the keydown output 224 high as shown in FIG. 6. With output 258 held low, gate 234 passes whichever data bit that is coincident with the recirculated data bit on line 86 from shift register 76. Since shift register 76 is synchronized to the manual scan, the delayed data will be the same note as is captured, and this continues to refresh the shift register 76 and prevent keydown flip-flop 220 from resetting. When the key is released, however, no further data will be loaded into shift register 76, and after two complete scans, flip-flop 220 will be reset and keyer 44 again rendered available for the capturing of another note.

Shift register 76 is utilized as a memory to monitor which note keyer 44 has captured. Shift register 76 is thirty-three stages long, with the extra bit provided by flip-flop 222 necessary for the time between the end of the scan and the start of the next scan. Shift registers 248 and 250 are negative edge triggered devices and the data also occurs on the negative edge. This allows the data to settle on the input up to flip-flop 222. The $\overline{Q}$ output 90 of flip-flop 222 carries the captured data pulse and is connected to data output 94 and also to the set input 92 of flip-flop 220.

Turning now to the data gating circuit 60 for slave keyer 42, its operation is nearly identical to master keyer 44. One difference is the presence of AND gate 270 which has its inputs connected to the Available outputs 56 and 58 of the flip-flops 202 and 220. Thus, AND gate 270 will disable OR gate 258 from capturing data if master keyer 44 is available to capture the note. Thus, the capture is accomplished on a priority basis with master keyer 44 given preference.

Gating 272 operates identically to gates 234, 236 and 242 to load data into shift register 78, and the $\overline{\text{data}}$ pulse on line 274 operates to prevent slave keyer 42 from capturing the data pulse in the event the same pulse has already been captured by master keyer 44.

The operation of the circuit of FIG. 5 results in a recurring pulse on either or both of data output lines 106 and 94 for the notes captured by the slave and master keyers 42 and 44. Thus, the capture system is capable of capturing two pedals when the system is in the pedal mode, or capturing a single note if the system is in the automatic bass mode.

Figure 7:
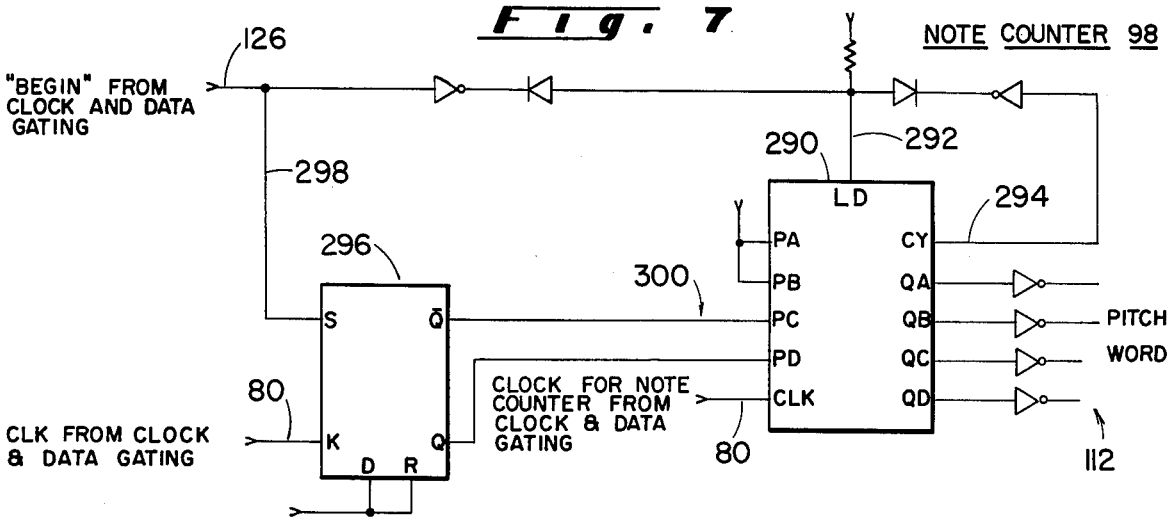
FIG. 7 is a circuit schematic of the note counter.

FIG. 7 illustrates the note counter 98, which comprises an MC714161 modulo counter 290 having its Load input 292 connected to line 126 from clock and data gating circuit 40 (FIG. 3), and its clock input 80 also connected to clock and data gating circuit 40. Counter 290 counts up from the value set on its preset inputs to binary 1111 at which time the Carry output 294 causes a load. Line 126 is high between manual scans, and this sets flip-flop 296 over line 298 causing the counter 290 presets 300 to be set at binary 1000.

On the first positive going edge of the clock, the preset is loaded into counter 290 thereby causing the inverted outputs 112 to be at binary 0111, which is the code for the G key, the highest frequency pedal on the particular organ in question. Also, the Begin line 126 goes low enabling flip-flop 296 to reset on the positive going edge of the clock thereby causing the preset inputs 300 to make a transition to binary 0100, which is the negative of binary 1011, the code for B. So, in the course of one manual scan, the counter 290 counts from binary 0111 to binary 0000, and then from binary 1011 to binary 0000 twice. This produces on outputs 112 a sequence of twelve four bit binary pitch words for one octave of keys, wherein the pitch words are repeated in succession for the thirty-two keys of pedalboard 12. The following chart indicates the binary values for the pitches of the keys:

| Code | Note |
|---|---|
| 0000 | C |
| 0001 | C# |
| 0010 | D |
| 0011 | D# |
| 0100 | E |
| 0101 | F |
| 0110 | F# |
| 0111 | G |
| 1000 | G# |
| 1001 | A |
| 1010 | A# |
| 1011 | B |

Figure 8:
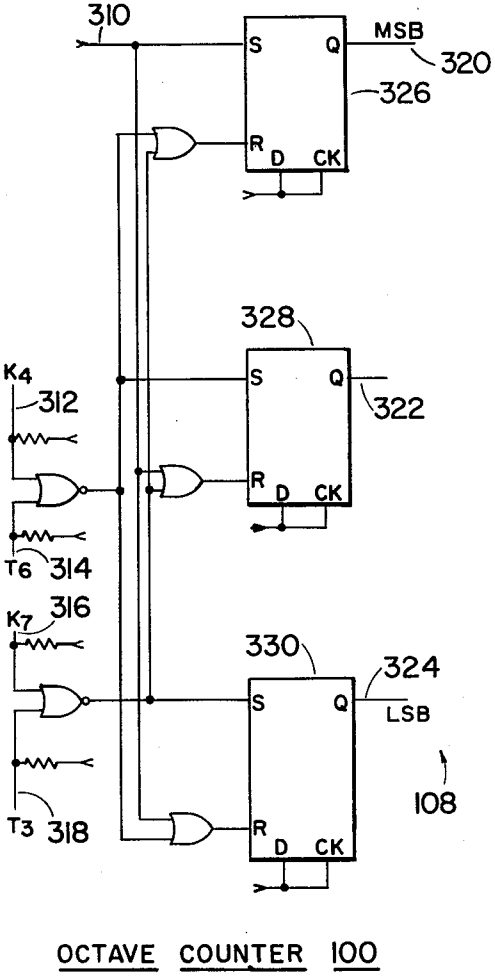
FIG. 8 is a circuit schematic of the octave counter.

FIG. 8 illustrates the octave counter 100, which is a modulo 3 counter clocked by the K3T7, K4T6 and K7T3 multiplexer driver signals. The K3T7 signal appears on line 310 from clock and gating circuit 40 (FIG. 3) and corresponds to binary 100, which is the third octave from the bottom on the pedalboard. K4T6 appears on lines 312 and 314, and corresponds to binary 010 for the second lowest octave of the pedalboard, whereas the K7T3 signals appear on lines 316 and 318 and correspond to binary 001 for the bottom octave of pedalboard 10. The three aforementioned binary codes appear on the outputs 320, 322 and 324 of flip-flops 326, 328 and 330 wherein output 320 is the most significant bit and output 324 is the least significant bit. Thus, counter 100 sequentially counts through states 100, 010 and 001 at the same rate that the corresponding octaves of the pedalboard (or the lowest two octaves of the great manual and the automatic bass mode) are scanned.

Figure 9:
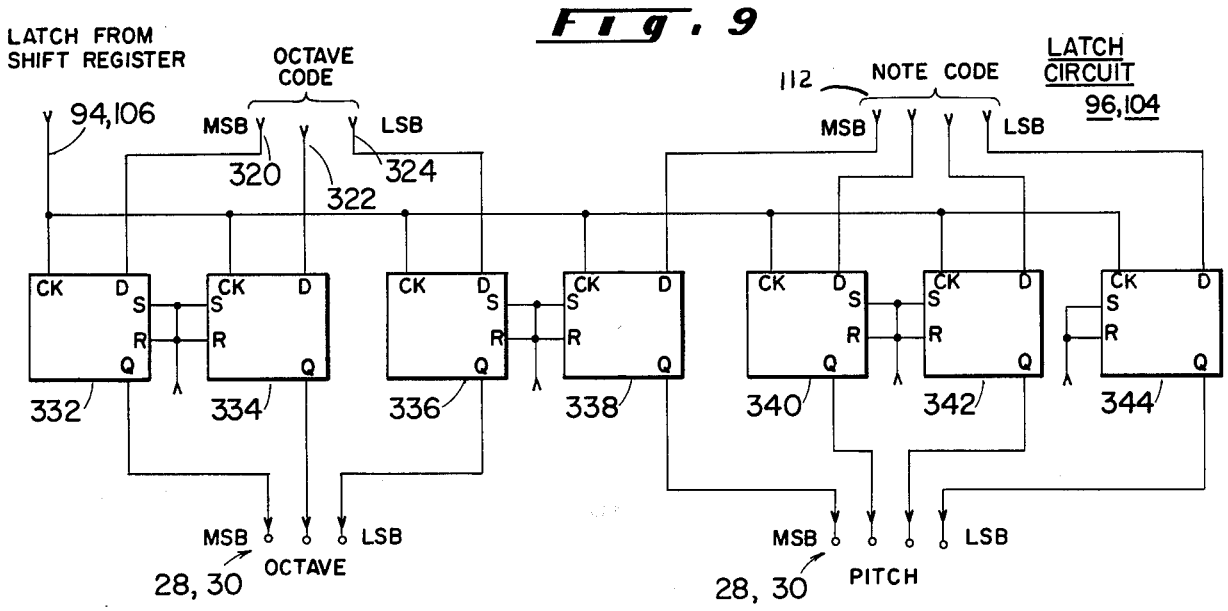
FIG. 9 is a circuit schematic of one of the latches.

Thus, counters 98 and 100 in conjunction produce on their outputs 108 and 112 a sequence of six bit words corresponding on a one-to-one basis to the keys of the pedalboard and the lowest thirty-two notes of the great manual, although only the lowest twenty-four notes of the great manual are actually utilized in the automatic bass mode. In order to enable one or two of these words to be transmitted to the respective programmable keyers 32 and 34, the words must be latched on the outputs 28 and 30 of latches 96 and 104. One of latch circuits 96 or 104 is illustrated in FIG. 9 and will be seen to comprise a series of D-type flip-flops 332, 334, 336, 338, 340, 342 and 344 connected to the outputs 320, 322 and 324 of octave counter 100, and the note code outputs 112 of note counter 98. Flip-flops 332-344 are latched by the data pulse on line 94 or 106 from the respective shift register 76 or 78, and since this data pulse is time coincident with the octave and note code for the particular key to be captured, the code produced at the outputs 30 or 28 of latch 96 or 104 will carry the appropriate note and octave information for that tone. This code can be used to program a programmable divider string, select a pitch from a tone selector and then program a divider string to select the proper octave, control a TOS system, or the like. The tones produced by keyer 32 or 34, or the tones produced by both of them, are amplified by amplifier 36 and converted into accoustic energy by speaker system 38.

While this invention has been described as having a preferred design, it will be understood that it is capable of further modification. This application is, therefore, intended to cover any variations, uses, or adaptations of the invention following the general principles thereof and including such departures from the present disclosure as come within known or customary practice in the art to which this invention pertains and fall within the limits of the appended claims.

What is claimed is:

1. In an electronic keyboard musical instrument comprising a keyboard having a plurality of playing keys, multiplex means for scanning said keyboard and producing a time division multiplexed serial data stream comprising a plurality of time slots corresponding to respective keys of the keyboard and keydown pulses in time slots corresponding to actuated ones of the keys, a keyer circuit comprising:

capture circuit means having an input to which said serial data stream is connected for capturing any uncaptured one keydown pulse that may be present in the serial data stream if the capture circuit means is in an Available mode, said capture circuit means capturing only said one keydown pulse regardless of the number of pulses in said data stream, means responsive to the capturing of a keydown pulse for placing said capture circuit means in an Unavailable mode as long as a keydown pulse is captured thereby, said capture circuit means being disabled from capturing a further keydown pulse when in the Unavailable mode, a recirculating memory means synchronized with the serial data stream for recirculating the captured keydown pulse, said capture circuit means including gating means, having an input connected to the serial data stream and an input to which the recirculated keydown pulse is connected, for rejecting all keydown pulses in the serial data stream except those keydown pulses that are time coincident with the recirculated keydown pulse when in the Unavailable mode, and tone code producing means having an input to which the captured keydown pulses are connected for producing a coded signal responsive to the time position of the captured keydown pulse wherein the coded signal pertains to the tone corresponding to the time position of the captured keydown pulse.

2. The musical instrument of claim 1 wherein said keyboard comprises a plurality of pedals normally depressed by the feet of the performer.

3. The musical instrument of claim 2 wherein there are two said keyer circuits respectively capable of capturing two diverse keydown pulses in the data stream, and including means interconnecting the two keyer circuits for preventing the keyer circuits from capturing the same keydown pulse.

4. The musical instrument of claim 3 wherein said means for preventing capturing comprises a coincidence gate circuit means in the gating means for each of said keyer circuits each having an input to which the serial data stream is connected and an input connected to the other one of the keyer circuits for carrying any keydown pulse captured by the other keyer circuit, said coincidence gate circuit means blocking the capturing of a keydown pulse by the respective keyer circuit if two keydown pulses are simultaneously present on the inputs of the coincidence gate circuit inputs.

5. The musical instrument of claim 1 including a plurality of said keyer circuits capable of capturing at the same time respective keydown pulses in the serial data stream, and including means for causing said keyer circuits to capture keydown pulses in a predetermined order of said keyer circuits.

6. The musical instrument of claim 1 wherein said keyboard is a pedalboard comprising a plurality of pedals normally depressed by the feet of the performer, and including a second keyboard comprising a plurality of playing keys normally played by the hands of the performer, second multiplex means for scanning the keys of the second keyboard and producing a time division multiplexed serial data stream comprising a plurality of time slots corresponding to the keys of the second keyboard and keydown pulses in time slots corresponding to the depressed keys of the keyboard, and automatic bass generator means having an input to which the keyboard data stream is connected for selecting only a single cyclically recurring keydown pulse in the second keyboard data stream pertaining to the lowest depressed key of the second keyboard within a selected group of the keys of the second keyboard, and selection means for connecting either the pedalboard serial data stream or the selected cyclically recurring pulse in the keyboard data stream to the capture circuit means input.

7. The musical instrument of claim 1 wherein said recirculating memory means comprises: a shift register having an output connected to the second mentioned input of said gating means, and an output connected to the tone producing means.

8. The musical instrument of claim 1 including release means for placing said capture circuit means in the Available mode if no keydown pulse is recirculated for a predetermined number of scans of the keyboard.

9. The musical instrument of claim 8 including means for generating a pulse at the end of each scan of the keyboard, and said release means has an input which is connected to the end of scan pulses and an input connected to the captured keydown pulse, and said release means places said capture circuit means in the Available mode after the receipt of a predetermined number of end of scan pulses without the intervening receipt of a keydown pulse at its input for the captured keydown pulse.

10. The musical instrument of claim 1 wherein said tone code producing means comprises a counter means running at the same rate as and in synchronism with said multiplex means and producing a series of counts on its output corresponding to the keys of the keyboard, and a latch means having a clocking input to which the captured keydown pulses are connected and inputs connected to the counter means output, and further including a tone generator means controlled by the latched counts to produce a tone corresponding to the latched count.

11. The musical instrument of claim 10 wherein said counter means includes a note counter which cyclically produces counts corresponding to the twelve pitches of the chromatic scale, and an octave counter means which produces counts corresponding to a plurality of octaves.

12. In an electronic keyboard musical instrument comprising a keyboard having a plurality of playing keys, multiplex means for scanning said keyboard and producing a time division multiplexed serial data stream comprising a plurality of time slots corresponding to respective keys of the keyboard and keydown pulses in time slots corresponding to actuated keys of the keyboard, a keying system comprising:

a plurality of keyer circuits fewer in number than the keys of the keyboard and each comprising: a capture circuit means having an input to which said serial data stream is connected for capturing any uncaptured one keydown pulse that may be present in the serial data stream if the capture circuit means is in an Available mode, means responsive to the capturing of a keydown pulse for placing said capture means in an Unavailable mode as long as a keydown pulse is captured thereby, said capture circuit means being disabled from capturing a further keydown pulse when in the Unavailable mode, a recirculating memory means synchronized with the serial data stream for recirculating the captured keydown pulse, said capture circuit means including gating means having an input connected to the serial data stream and an input to which the recirculated keydown pulse is connected for rejecting all keydown pulses in the serial data stream except those that are time coincident with the recirculated keydown pulse when in the Unavailable mode, and means responsive to the captured keydown pulse for producing a tone corresponding to the key pertaining to the captured keydown pulse, priority selection means connected with all of said keyer circuits for causing those keyer circuits which are in the Available mode to capture keydown pulses in the serial data stream in a predetermined order, and lockout means connected with each of said keyer circuits for preventing the respective keyer circuit from capturing a keydown pulse already captured by another keyer circuit.

13. The musical instrument of claim 2 wherein said keyboard comprises a plurality of pedals normally depressed by the feet of the performer.

14. The musical instrument of claim 12 wherein said keyboard is a pedalboard comprising a plurality of pedals normally depressed by the feet of the performer, and including a second keyboard comprising a plurality of playing keys normally played by the hands of the performer, second multiplex means for scanning the keys of the second keyboard and producing a time division multiplexed serial data stream comprising a plurality of time slots corresponding to the keys of the second keyboard and keydown pulses in time slots corresponding to the depressed keys of the keyboard, and automatic bass generator means having an input to which the keyboard data stream is connected for selecting only a single cyclically recurring keydown pulse in the second keyboard data stream pertaining to the lowest depressed key of the second keyboard within a selected group of the keys of the second keyboard, and selection means for connecting either the pedalboard serial data stream or the selected cyclically recurring pulse in the keyboard data stream to the capture circuit means input.

15. The musical instrument of claim 12 wherein said recirculating memory means comprises: a shift register having an output connected to the second mentioned input of said gating means, and an output connected to the tone producing means.

16. The musical instrument of claim 12 wherein each of said keyer circuits includes a release means for placing the respective capture circuit means in the Available mode if no keydown pulses recirculated for a predetermined number of scans of the keyboard.

17. The musical instrument of claim 12 wherein said means for producing a tone comprises: a counter means shared by all of said keyer circuits and running at the same rate as and in synchronism with said multiplex means and producing a series of counts on its output corresponding to the keys of the keyboard, and a plurality of latches having clocking inputs connected respectively to the keyer circuits and responsive to the keydown pulses captured thereby and having inputs connected to the output of said counter means, and a plurality of tone generator means responsive to the respective latched counts.

18. In an electronic organ having a pedalboard with a plurality of pedals normally played by the feet of the performer, a keyboard with a plurality of playing keys normally played by the hands of the performer, pedal multiplex means for scanning said pedalboard and producing a pedal time division multiplexed serial data stream comprising a plurality of time slots corresponding to the pedals of the pedalboard with keydown pulses in time slots pertaining to actuated ones of the pedals, and keyboard multiplex means for scanning said keyboard and producing a keyboard time division multiplexed serial data stream comprising a plurality of time slots corresponding to the keys of the keyboard with cyclically recurring keydown pulses in time slots pertaining to actuated ones of the keys, the time slots corresponding to keys and pedals of like pitch and octave positions occurring simultaneously so that the data streams are synchronized with each other, a system for producing base tones comprising:

a selectively actuable automatic bass generator means having an input to which the keyboard data stream is connected for selecting only a single cyclically recurring keydown pulse in the keyboard data stream pertaining to the lowest in frequency actuated key of the keyboard within a selected group of the keys of the keyboard, capture circuit means having an input, selection means for connecting either the pedal serial data stream or the selected cyclically recurring single pulse keydown in the keyboard data stream to the capture circuit means input, said capture circuit means including means for capturing said selected keydown pulse if it is connected to said capture circuit means input or for capturing any uncaptured one keydown pulse that may be present in the pedal data stream if the capture circuit means is in the Available mode, means responsive to the capturing of a keydown pulse for placing said capture circuit means in an Unavailable mode as long as a keydown pulse is captured thereby, said capture means being disabled from capturing a further pulse when in the Unavailable mode, and a recirculating memory for recirculating the captured keydown pulse in synchronism with the data streams and preventing the capturing of a further keydown pulse in a time slot other than the time slot of the recirculating keydown pulse.

19. The musical instrument of claim 18 wherein said automatic bass generator means comprises a counter means clocked in synchronism with the multiplexing of said keyboard for producing on an input of said selection means a pulse when the counter has reached a predetermined count, a reset input connected to the keyboard data stream, and means for resetting the counter each time a keydown pulse appears on the reset input.

* * * * *